US005626377A

United States Patent [19]

Carroll, Jr. et al.

[11] Patent Number: 5,626,377

[45] Date of Patent: May 6, 1997

[54] APPARATUS FOR CLEANING DRAIN TROUGHS

[76] Inventors: William C. Carroll, Jr., 360 Hub Tatum Rd., Sautee, Ga. 30571; Timothy P. Carroll, 175 Farm Hill Cir., Roswell, Ga. 30075; William C. Carroll, Sr., 131 Laurel Park Dr., Cleveland, Ga. 30528

[21] Appl. No.: 647,673

[22] Filed: May 15, 1996

[51] Int. Cl.[6] ..... E04D 13/076

[52] U.S. Cl. ..... 294/19.1; 15/236.04

[58] Field of Search ..... 294/19.1, 22, 23, 294/50.8, 50.9, 103.1, 104; 15/105, 236.04; 56/333, 334

[56] References Cited

U.S. PATENT DOCUMENTS

| | | | |
|---|---|---|---|
| 2,720,409 | 10/1955 | Griffith | 294/19.1 |
| 3,601,835 | 8/1971 | Morgan | 294/19.1 X |
| 3,743,339 | 7/1973 | Brackett | 294/19.1 |
| 3,972,552 | 8/1976 | Earp | 294/19.1 |
| 4,057,276 | 11/1977 | Currie | 294/19.1 |
| 4,114,938 | 9/1978 | Strader | 294/19.1 |
| 4,196,927 | 4/1980 | Lomaga | 294/19.1 |
| 4,310,940 | 1/1982 | Moore | 294/19.1 X |
| 4,319,851 | 3/1982 | Arthur | 294/19.1 X |
| 4,447,927 | 5/1984 | Malless | 294/19.1 X |
| 4,930,824 | 6/1990 | Matthews et al. | 294/19.1 |

*Primary Examiner*—Johnny D. Cherry
*Attorney, Agent, or Firm*—Norman B. Rainer

[57] ABSTRACT

Apparatus for removing debris from an eaves drain trough employs an elongated handle, a support arm positioned atop the handle and having a contour which accommodates the trough, and a gripping mechanism pendently held by the support arm. The gripping mechanism has upper and lower elongated arms that are pivotally joined at one extremity and spring-urged into a contacting relationship which grips the debris. A tether line downwardly directed from the support arm extends toward the bottom of the elongated handle. A downward pulling force applied to the tether causes the upper and lower arms to separate in jaw-like fashion. Release of the downward pulling force enables the arms to close upon and thereby grip any intervening debris.

8 Claims, 4 Drawing Sheets

APPARATUS FOR CLEANING DRAIN TROUGHS

BACKGROUND OF THE INVENTION

1. Field of the Invention

This invention concerns apparatus for cleaning an overhead drain trough associated with the lower extremity of a pitched roof.

2. Description of the Prior Art

Most residential-type houses are constructed with pitched roofs. The sloped or angled nature of the roof prevents the accumulation of water, and in many instances minimizes the accumulation of snow. At the lowest extremity of a pitched roof, generally referred to as the eave, there is positioned a drain trough or gutter, the purpose of which is to catch the water which runs off the roof, and channel it to a downspout which leads the water away from the foundation of the house.

In the course of time, such drain gutters tend to accumulate debris such as fallen leaves, which obstruct the gutter and render it ineffective for its intended purpose. The considerable weight of the debris plus entrapped stagnant water causes the trough to sag, warp and eventually pull away from the eave.

The cleaning of the trough is often done manually by climbing onto the roof or by employing a ladder which is leaned against the trough. Either approach is difficult and often perilous.

Devices utilizing long poles have earlier been disclosed for enabling a person to clean a gutter while standing upon the ground beneath the gutter. Such devices are disclosed for example in U.S. Pat. Nos. 3,743,339; 3,972,552; 4,057,276; 4,114,938; 4,196,927; 4,310,940; 4,319,851; 4,930,824; and 5,288,118. Such devices generally employ a working head positioned atop the pole and configured to seat downwardly into the gutter. The head functions either to push, scoop, lift or grab debris within the gutter. By moving the head laterally along the gutter in successive manipulations, the debris is removed. In those devices where the head contains moving components, a lever, rope or other elongated force-conveying manipulation means extends between the head and the lower extremity of the pole.

The aforesaid gutter-cleaning devices are generally difficult to use because of their relatively heavy weight The head component is usually not easily separable from the pole component, thereby presenting difficulties in packaging for marketing purposes and in storage by the user. The head component in many such devices is subject to malfunction during interaction with the debris in the gutter, and the head component is often configured to operate in just a single lateral direction within the straight, horizontally disposed gutter. Such directional limitation causes one extremity of the gutter to be inaccessible to the device, and said extremities are of critical concern because downspouts which service the gutter are usually associated with an extremity of the gutter.

It is accordingly an object of the present invention to provide apparatus for cleaning an eaves drain trough.

It is a further object of this invention to provide apparatus as in the foregoing object which can be hand-operated by a person standing upon the ground below said drain trough.

It is another object of the present invention to provide apparatus of the aforesaid nature which can operate in both lateral directions of the drain trough.

It is a still further object of this invention to provide apparatus of the aforesaid nature easily amenable to disassembly to a compact storage state.

It is yet another object of the present invention to provide apparatus of the aforesaid nature which is of light weight, and simple and durable construction amenable to low cost manufacture.

These objects and other objects and advantages of the invention will be apparent from the following description.

SUMMARY OF THE INVENTION

The above and other beneficial objects and advantages are accomplished in accordance with the present invention by an apparatus for cleaning a straight, horizontally disposed eaves drain trough, said apparatus comprising:

a) elongated handle means having a top end, and a bottom end adapted to be held by an operator, b) a support arm having a lower extremity that removably engages the top end of said handle means, a middle portion of substantially U-shaped configuration located above and offset from said lower extremity, and a downwardly directed upper extremity disposed at an elevation within said middle portion, said upper and lower extremities and middle portion lying in the same vertical plane, c) a gripping mechanism comprising:

1) a control tube vertically elongated between a lower extremity and an open upper extremity that removably receives and engages the upper extremity of said arm, 2) a lower gripping member horizontally elongated between a leading extremity and trailing extremity and further bounded by upper and lower surfaces, said lower gripping member being fixedly attached to the lower extremity of said control tube in orthogonal relationship to the plane of said support arm, 3) an upper gripping member horizontally elongated between a leading extremity and a trailing extremity that hingedly engages the trailing extremity of said lower gripping member, and further bounded by upper and lower surfaces, said upper gripping member having a slotted aperture that is penetrated by said control tube, and tether-securing means associated with its upper surface adjacent its leading extremity, and 4) restoring means for urging said upper gripping member downwardly into contact with said lower gripping member, and d) a control tether extending from a proximal extremity secured by said tether-engaging means to a free distal extremity disposed adjacent the bottom end of said handle means, and e) guide means associated with said support arm that permit sliding passage of said control tether.

In preferred embodiments of the apparatus, the leading extremity of said upper gripping member is provided with an upwardly directed abutment surface. The leading extremity of said lower gripping member may be partially pointed or bevelled to expedite penetration of debris.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 1:
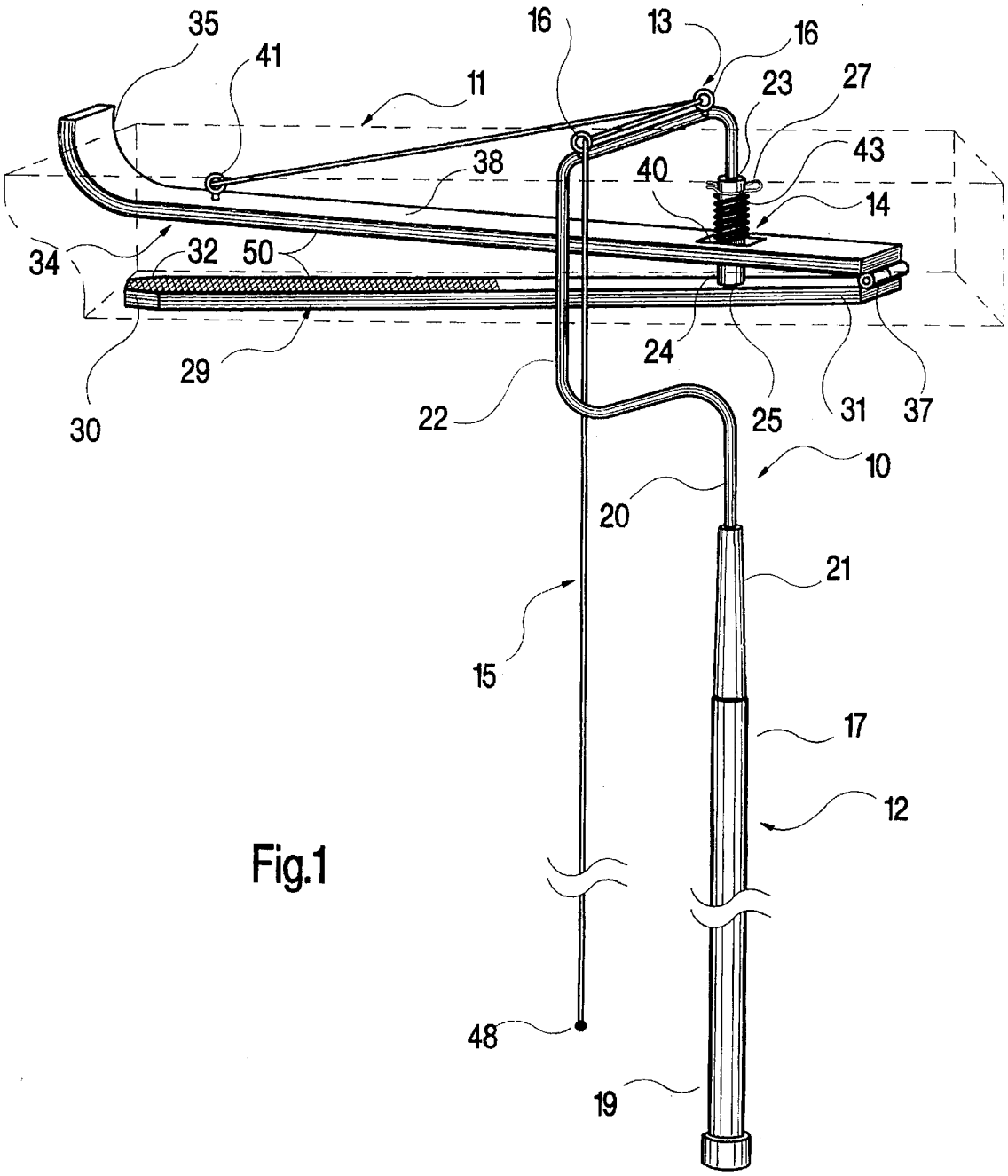
FIG. 1 is a top and rear perspective view of an embodiment of the gutter cleaning apparatus of the present invention.
Figures 2, 4:
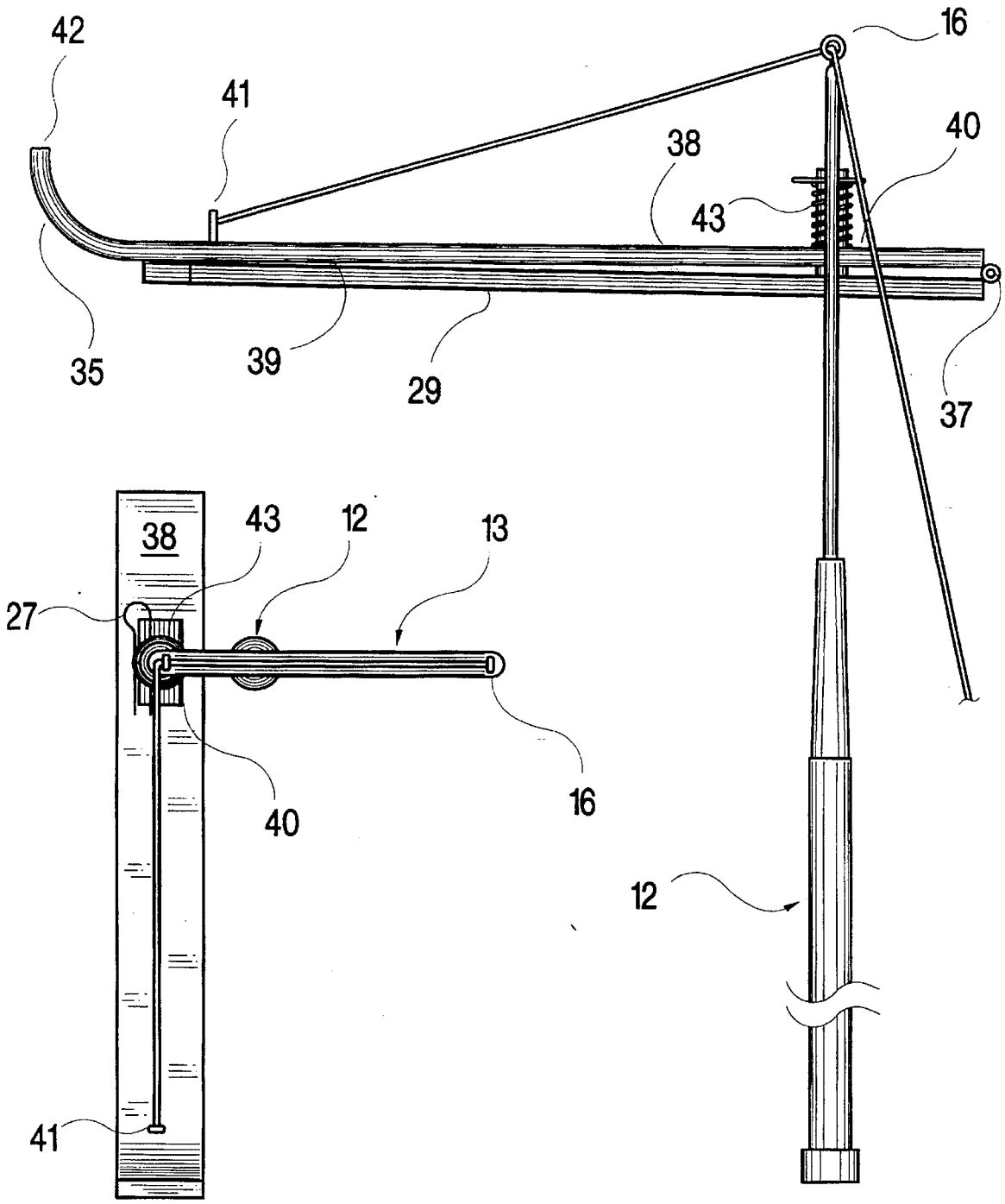
FIG. 2 is a top plan view.
FIG. 4 is a rear view.
Figures 3, 7:
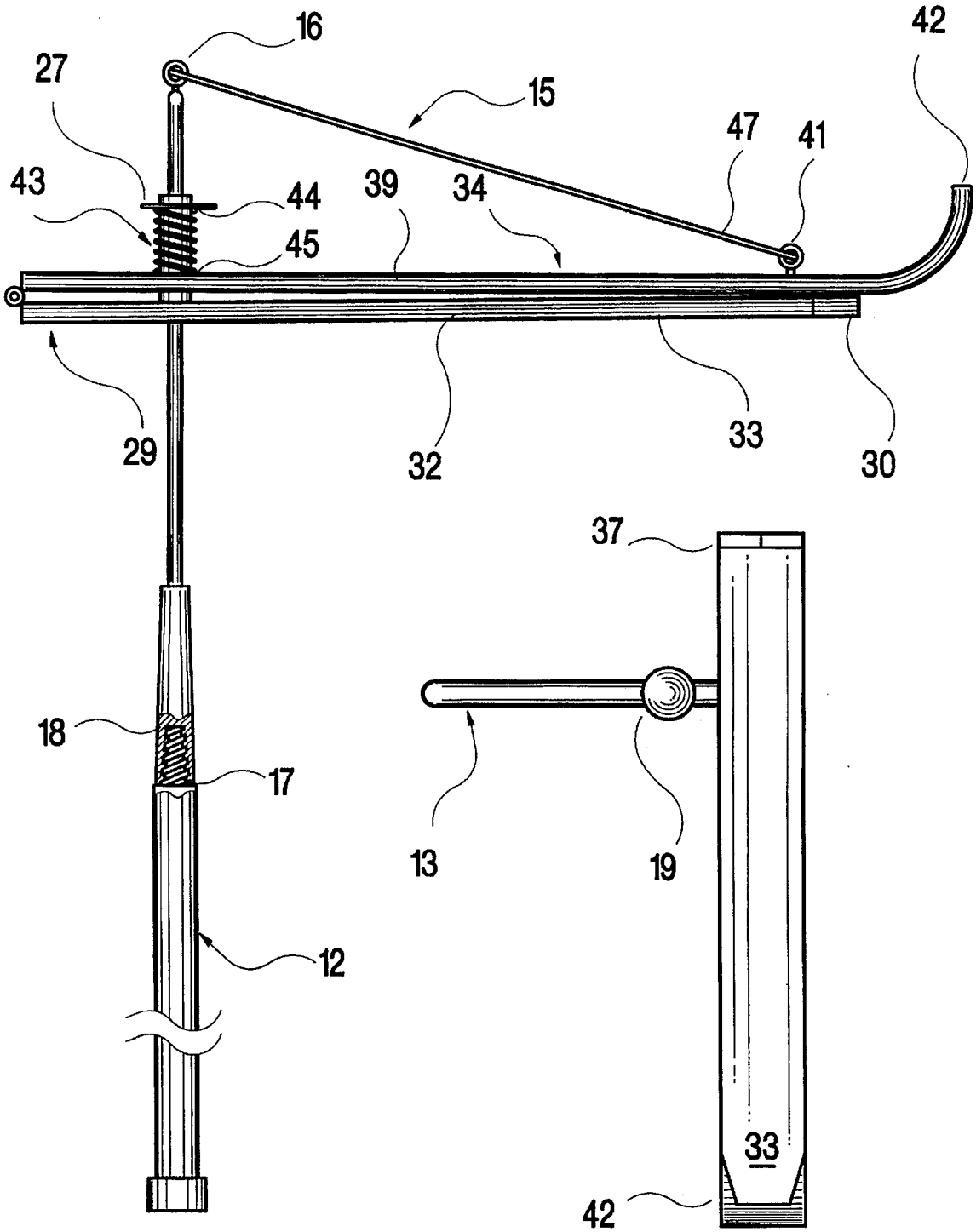
FIG. 3 is a front view with portions broken away.
FIG. 7 is a bottom view.
Figure 5:
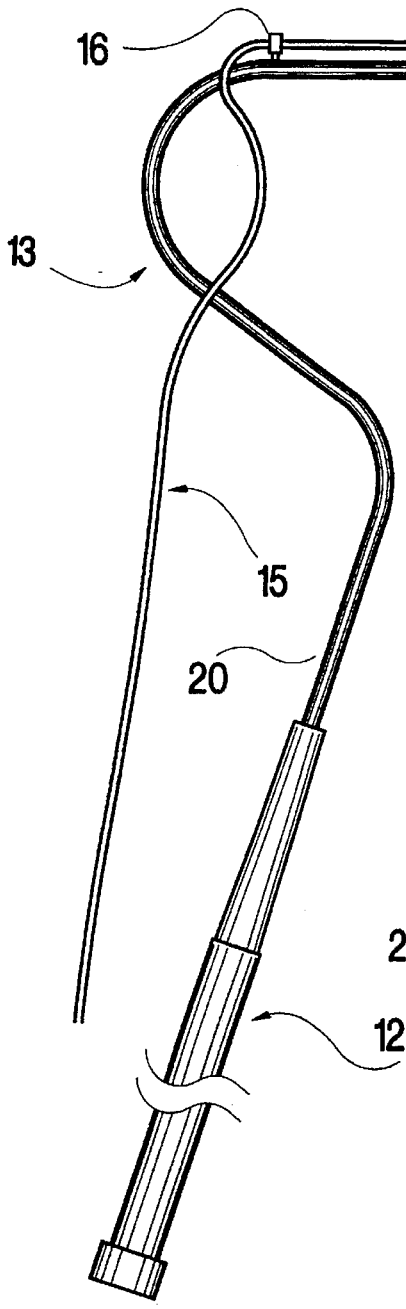
FIG. 5 is a side view taken from the left of FIG. 3.
Figure 6:
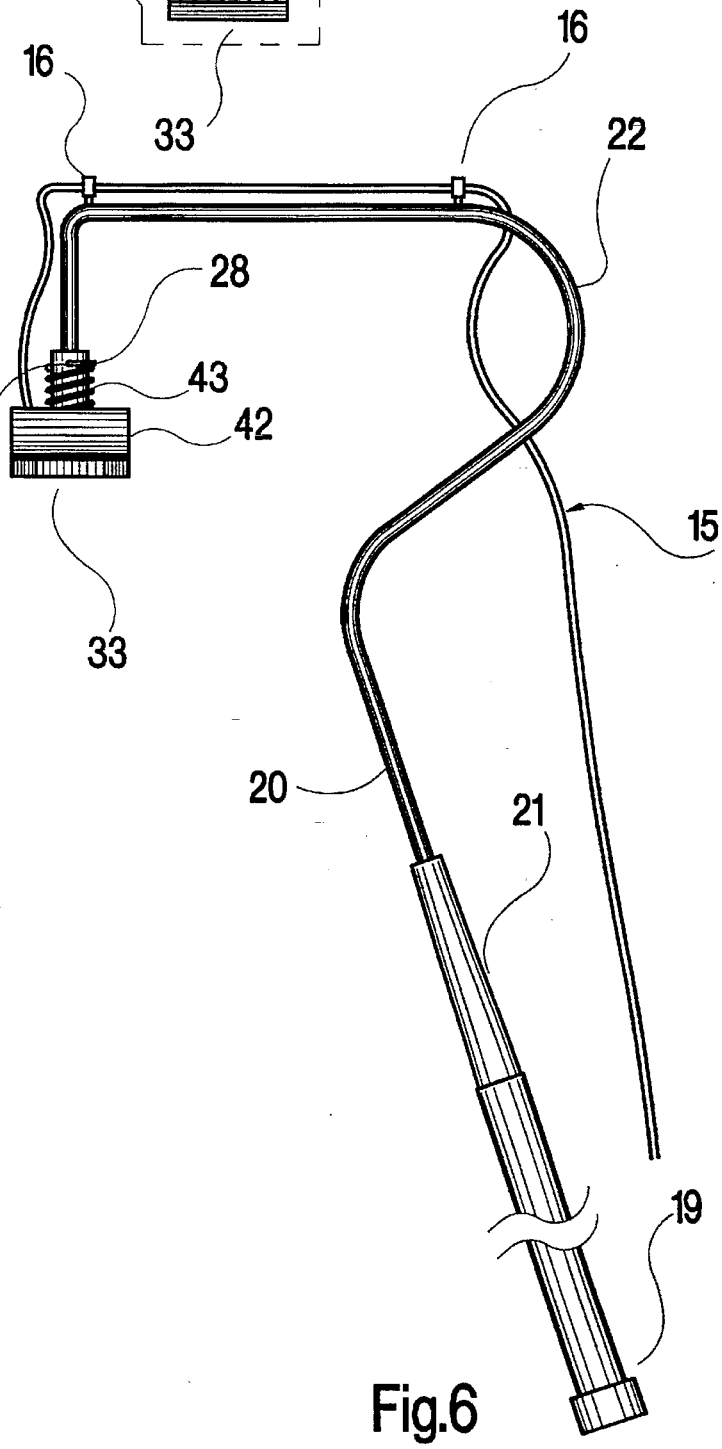
FIG. 6 is a side view taken from the right of FIG. 3.

Referring to FIGS. 1–7, an embodiment of the drain trough cleaning apparatus 10 of the present invention is shown in operative association with a drain trough or gutter 11.

Apparatus 10 is comprised of elongated handle means 12, support arm 13, gripping mechanism 14, control tether 15 and guide means 16 which accommodate said tether.

Handle means 12 is of elongated, rigid and light weight construction. Suitable embodiments include hollow tubing fabricated of aluminum or light weight plastic material. The top end 17 of said handle means may be provided with attachment means such as a threaded region 18 or equivalent structure to permit releasible coupling with support arm 13 or with an extension segment of said handle means. Handle means 12 may be a single monolithic structure, or may be segmented or of telescoping construction to permit adjustability of its overall length. The bottom end 19 of said handle means may contain a protective rubber cup or other means to facilitate manual manipulation of the apparatus.

Support arm 13 is exemplified in the illustrated embodiment as being fabricated of a single piece of aluminum tubing bent into desired shape. Said support arm has a lower extremity 20 equipped with an adaptor 21 that removably engages the top end of handle means 12, a middle portion 22 of substantially U-shaped configuration located above and offset from lower extremity 20, and a downwardly directed upper extremity 23 disposed at an elevation within said middle portion. Said upper and lower extremities and middle portion are centered within the same vertical plane.

Gripping mechanism 14 is comprised of control tube 24 vertically elongated between a lower extremity 25 and an open upper extremity 26 that receives the upper extremity 23 of support arm 13. Said support arm is removably secured within tube 24 by virtue of cotter pin 27 that penetrates diametrically opposed apertures 28 in tube 24 and an aligned hole in said support arm.

A lower gripping member 29 is horizontally elongated between a leading extremity 30 and trailing extremity 31, and is further bounded by upper and lower surfaces 32 and 33, respectively. Said upper surface 32 is fixedly attached to the lower extremity 25 of control tube 24. The site of said attachment is preferably closer to said trailing extremity than said leading extremity, and in particular is preferably located between 20% and 30% of the length of said gripping member, measured from said trailing extremity. The total length of gripping member 29 may range between about 10 and 20 inches. The manner of attachment of gripping member 29 to control tube 24 is such as to dispose said gripping member substantially orthogonally to the plane of said support arm. Leading extremity 30 may be somewhat pointed, flattened or bevelled in a manner to expedite penetration of gutter debris. Although exemplified is a solid panel, gripping member 29 may be constructed as a perforated plate, grating or other suitable structure.

An upper gripping member 34 is horizontally elongated between a leading extremity 35 and trailing extremity 36 that interacts with hinge means 37 in joinder with the trailing extremity of lower gripping member 29. Gripping member 34 is further bounded by upper and lower surfaces 38 and 39, respectively, and is penetrated by a slotted aperture 40 elongated in the direction of elongation of said gripping member. The function of said aperture is to permit close-fitting passage of control tube 24. Tether securing means in the form of eyelet 41 is associated with upper surface 38 adjacent leading extremity 35. Said leading extremity in the illustrated embodiment, is provided with an upturned abutment surface 42 whose function is to push debris within the gutter.

By virtue of the aforesaid components and their interaction, upper surface 32 of said lower gripping member, and lower surface 39 of said upper gripping member are disposed in facing relationship. Said facing surfaces 32 and 39 are preferably provided with patterned regions 50 which may be in the form of intermeshing teeth, or upraised protrusions and mating recesses. The purpose of the patterned regions is to enhance the gripping of debris.

Restoring means in the form of coil spring 43 is interactive between control tube 24 and upper gripping member 34 in a manner to bias said upper gripping member downwardly into contact with said lower gripping member. In such function, the upper extremity 44 of said spring abuts cotter pin 27, and the lower extremity 45 of said spring is freely moveable against the upper surface of upper gripping member 34.

Control tether 15, which may be a strong thin, non-elongating line, is attached at its proximal extremity 47 to eyelet 41. The tether is of sufficient length so that the free distal extremity 48 is located close to the bottom end 19 of said handle.

Guide means in the form of eyelets 16 attached to the middle portion of support arm 13 permit sliding passage of the tether, enabling a downwardly applied force upon the tether to lift upper gripping member 34.

In use, the apparatus of this invention is positioned by handle means 12 such that the lower surface 33 of lower gripping member 29 is in sliding contact with the bottom of gutter 11. The tether is pulled downwardly, causing the upper gripping member to raise in pivotal motion about said lower gripping member to produce a V-shaped jaw-like configuration. The apparatus is moved by the operator horizontally in the direction of said V-shaped opening. The tether is then released, causing gutter debris to be held between said upper and lower gripping members. The apparatus is then raised and removed from the gutter, and the upper gripping member is again raised, causing release of the debris. When it is desired to clean the gutter in the opposite direction, the cotter pin is removed, and the gripping mechanism is rotated 180 degrees, and re-secured by the cotter pin.

While particular examples of the present invention have been shown and described, it is apparent that changes and modifications may be made therein without departing from the invention in its broadest aspects. The aim of the appended claims, therefore is to cover all such changes and modifications as fall within the true spirit and scope of the invention.

Having thus described our invention, what is claimed is:

1. An apparatus for removing debris from a straight, horizontally disposed eaves drain trough, said apparatus comprising:

a) elongated handle means having a top end and a bottom end adapted to be held by an operator, b) a support arm having a lower extremity that removably engages the top end of said handle means, a middle portion of substantially U-shaped configuration located above and offset from said lower extremity, and a downwardly directed upper extremity disposed at an elevation within said middle portion, said upper and lower extremities and middle portion lying in the same vertical plane, c) a gripping mechanism comprising:

1) a control tube vertically elongated between a lower extremity and an open upper extremity that removably receives and engages the upper extremity of said support arm, 2) a lower gripping member horizontally elongated between a leading extremity and trailing extremity and further bounded by upper and lower surfaces, said lower gripping member being fixedly attached to the lower extremity of said control tube in orthogonal relationship to the plane of said support arm, 3) an upper gripping member horizontally elongated between a leading extremity and a trailing extremity that hingedly engages the trailing extremity of said lower gripping member, and further bounded by upper and lower surfaces, said upper gripping member having a slotted aperture that is penetrated by said control tube, and tether-securing means associated with its upper surface adjacent its leading extremity, and 4) restoring means for urging said upper gripping member downwardly into contact with said lower gripping member, d) a control tether extending from a proximal extremity secured by said tether-securing means to a free distal extremity disposed adjacent the bottom end of said handle means, and e) guide means associated with said support arm that permit sliding passage of said control tether.

2. The apparatus of claim 1 wherein the upper surface of said lower gripping member and the lower surface of said upper gripping member are disposed in facing relationship.

3. The apparatus of claim 2 wherein said facing surfaces are provided with patterned regions which enhance the gripping of said debris.

4. The apparatus of claim 1 wherein said leading extremity of said upper gripping member is provided with an upwardly directed abutment surface.

5. The apparatus of claim 1 wherein said leading extremity of said lower gripping member is pointed so as to expedite penetration of said debris.

6. The apparatus of claim 1 wherein said gripping mechanism can be rotated about the upper extremity of said support arm and engaged in an oppositely directed position.

7. The apparatus of claim 1 wherein said restoring means is a coil spring disposed about said control tube, said coil spring having an upper extremity, and a lower extremity that bears against the upper surface of said lower gripping member.

8. The apparatus of claim 7 wherein the upper extremity of said coil spring bears against a pin that penetrates said control tube and support arm.

* * * * *